United States Patent [19]

Oshima et al.

[11] Patent Number: 5,026,183

[45] Date of Patent: Jun. 25, 1991

[54] APPARATUS FOR FEEDING CUT SHEET PAPER AND FAN FOLD PAPER IN A PRINTER

[75] Inventors: Keiichi Oshima; Takashi Kato; Susumu Murayama, all of Suwa, Japan

[73] Assignee: Seiko Epson Corporation, Tokyo, Japan

[21] Appl. No.: 323,528

[22] Filed: Mar. 14, 1989

[30] Foreign Application Priority Data

Mar. 14, 1988 [JP] Japan ..... 63-59688
Jun. 17, 1988 [JP] Japan ..... 63-149301

[51] Int. Cl.[5] ..... B41J 11/50

[52] U.S. Cl. ..... 400/605; 400/608.3; 400/611; 226/101

[58] Field of Search ..... 400/605, 607, 616, 617, 400/619, 608.3, 611, 708, 624; 226/101

[56] References Cited

U.S. PATENT DOCUMENTS 4,761,087 8/1988 Ward et al. ..... 400/605
4,929,104 5/1990 Yokoi et al. ..... 400/605

FOREIGN PATENT DOCUMENTS 60-44379 3/1985 Japan ..... 400/607
192576 8/1986 Japan ..... 400/605
62-80072 4/1987 Japan ..... 400/607
119068 5/1987 Japan ..... 400/605

*Primary Examiner*—Clifford D. Crowder
*Assistant Examiner*—Ren Yan
*Attorney, Agent, or Firm*—Blum Kaplan

[57] ABSTRACT

An apparatus for feeding both cut sheet paper and fan fold paper in a printer adapted to process both fan fold paper and cut sheet paper has a platen supported within the printer. A paper pressing member comes in contact with the platen to slidably retain the paper therebetween. A push tractor upstream of the platen feeds fan fold paper towards the platen. A control circuit controls the push tractor to feed fan fold paper in a backward direction once the printer has received an indication that cut sheet paper is to be processed. The tractor feeds the fan fold paper in a forward direction towards the platen upon completion of the feeding of cut sheet paper. The control circuit causes the push tractor to feed the paper in a reciprocating manner prior to returning the paper to an original print position at which fan fold printing may be resumed.

3 Claims, 4 Drawing Sheets

APPARATUS FOR FEEDING CUT SHEET PAPER AND FAN FOLD PAPER IN A PRINTER

BACKGROUND OF THE INVENTION

The present invention relates to an apparatus for feeding cut sheet paper and fan fold paper in a printer, and in particular, to an apparatus which allows interruption of printing on fan fold paper to permit printing on cut sheet paper and then resets the fan fold paper to the proper printing position.

Printers which utilize both cut sheet paper and fan fold paper are known in the art. In conventional printers, to allow cut sheet printing during a fan fold printing operation, printing is interrupted and the fan fold paper is removed from the paper feeding path to allow cut sheet printing. The fan fold paper is then returned to its original position to begin printing of the fan fold paper.

Such forward and backward movement of the fan fold paper within the paper path causes paper sagging within the paper path which results in print displacement. This problem particularly arises in push tractor feeder printers which do not have a pull mechanism to at least partially compensate for the sagging. Additionally, printers which utilize a push tractor feeder in connection with a pull tractor feeder are complex, cumbersome and make it difficult to adjust first line printing pitch once the fan fold paper has been returned.

Accordingly, it is desired to provide an apparatus for feeding both cut sheet and fan fold paper which overcomes the shortcomings of the prior art by providing an apparatus capable of reducing slack in the fan fold paper feed path.

SUMMARY OF THE INVENTION

In accordance with the present invention, an apparatus for feeding cut sheet paper and fan fold paper in a printer is provided. The apparatus includes a platen and a paper pressing member which contacts the platen to position paper therebetween. A push tractor for feeding fan fold paper towards the platen is located upstream of the platen. A control circuit controls the push tractor to feed fan fold paper in a backward direction once the printer has received an indication that cut sheet paper is to be processed. The control circuit feeds the fan fold paper backwards for a length equal to the amount in which the fan fold paper was previously fed forwards. Upon completion of the cut sheet paper processing, the fan fold paper is fed forward to the platen for a predetermined amount, then fed forward and backward in a reciprocating motion so that the leading edge of the fan fold paper projects beyond the pressing member when the fan fold paper is to be repositioned to continue printing.

Accordingly, it is an object of this invention to provide an improved apparatus for feeding both fan fold paper and cut sheet paper in a single printer.

Another object of the present invention is to provide an apparatus for feeding paper in a printer adapted to print on both fan fold paper and cut sheet paper which positions the paper accurately at the original print position without regard to printing interruptions.

A further object of the present invention is to provide an apparatus for feeding fan fold paper in a printer adapted to utilize both fan fold paper and cut sheet paper which reduces the amount of slack in fan fold paper within the paper feed path.

Still other objects and advantage of the invention will in part be obvious and in part be apparent from the specification.

The invention accordingly comprises the several steps in relation of one or more of such steps with respect to each of the others and the apparatus embodying features and construction, combination of elements and arrangement of parts which are adapted to effect such steps, all of this exemplified in the following detailed disclosure, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
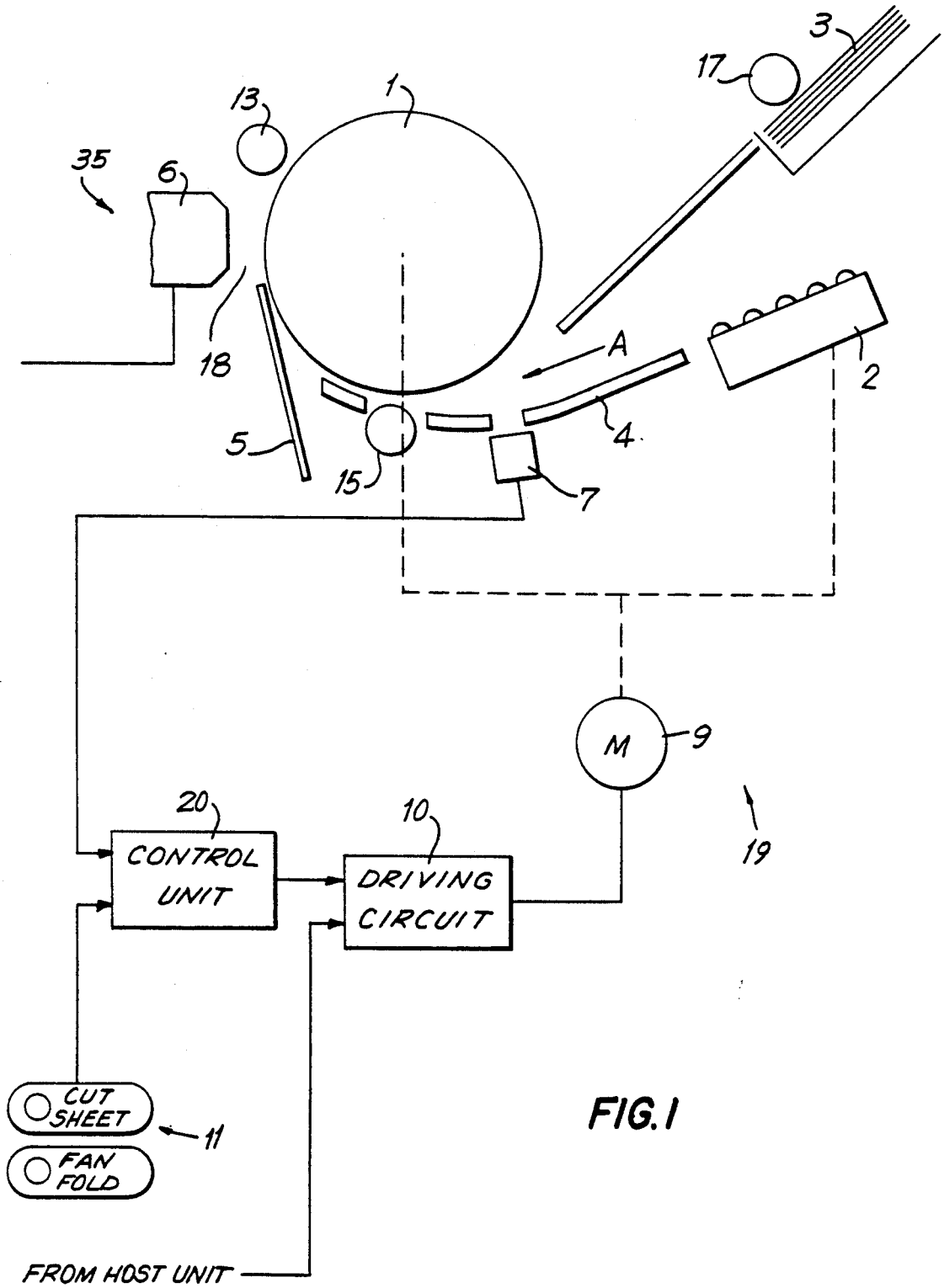
FIG. 1 is a partial sectional view and schematic diagram of an apparatus for feeding both fan fold paper and cut sheet paper in a printer constructed in accordance with the invention.

Reference is first made to FIG. 1, wherein an apparatus for feeding both cut sheet paper and fan fold paper in a printer, generally indicated at 35, and constructed in accordance with the invention is provided. A platen 1 is rotatably supported within a printer generally shown at 19. A push tractor 2 for feeding fan fold paper is provided upstream of platen 1 in a direction of paper feeding indicated by the arrow A. A cut sheet feeder 3, such as that known from U.S. Pat. No. 4,248,415, and which may be used in conjunction with a tractor feed is mounted on printer 19 upstream of platen 1. A paper pressing member 5 is provided downstream of platen 1 and is elastically brought into contact with platen 1 for securing paper between platen 1 and pressing member 5. A paper guide 4 having an idler wheel 15 therein is provided between tractor push feeder 2 and cut paper feeder 3 and paper pressing member 5 and guides paper ejected from either cut paper feeder 3 or tractor push feeder 2 to platen 1.

A paper detector 7 is provided upstream of platen 1 at a predetermined position to detect the leading edge of fan fold paper as it is fed by push tractor feeder 2 about platen 1. A print head 6 is positioned across a gap 18 from platen 1 downstream of paper press member 5. A paper bail 13 is positioned downstream of print head 6. A roller 17 is positioned at cut sheet feeder 3 to aid the supply of cut sheets.

Platen 1 and push tractor feeder 2 are driven through a transmission mechanism by a common pulse motor 9. Pulse motor 9 is in turn driven by a motor driving circuit 10 which receives control signals from a control unit 20 and from the host unit to which the printer is coupled. In an exemplary embodiment control unit 20 is a microcomputer. Control unit 20 receives an input from paper detector 7. A switch 11 is used to manually select between a cut sheet mode and fan fold mode for instructing control unit 20 as to which type of paper is being processed.

Figure 2:
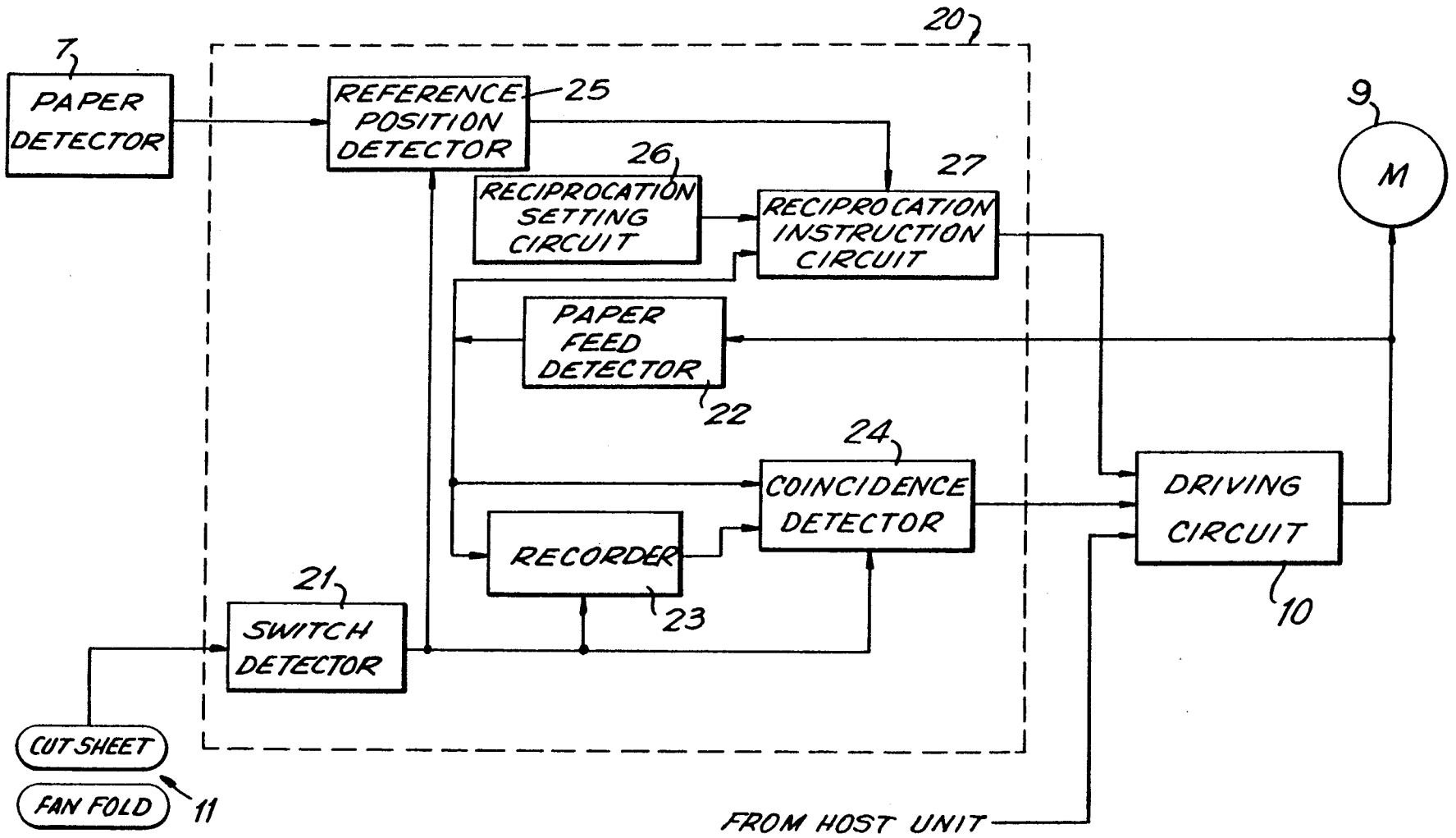
FIG. 2 is a block diagram of a control unit constructed in accordance with the invention.

Reference is now made to FIG. 2 in which one embodiment of control device 20 is provided. A switch detector 21 receives the input from switch 11 and provides an output to a reference position detector 25, a recorder 23 and to a coincidence detector 24. Reference position detector 25 also receives an input from paper detector 7 and provides an output to reciprocation instructing circuit 27. Reciprocation instructing circuit 27 also receives an input from reciprocation setting circuit 26 and paper feed detector 22 to provide an output to driving circuit 10. Coincidence detector 24 also receives an input from recorder 23 and paper feed detector 22 and provides an input to driving circuit 10. Paper feed detector 22 receives an input from driving circuit 10 providing a self controlling feed back system.

Switch is set between either a cut sheet print indication or a fan fold print indication and outputs an indication signal. Switch detector 21 differentiates the fan fold paper from the cut sheet paper by interpreting the signal transmitted by switch 11 and produces a cut sheet signal or fan fold signal. The cut sheet signal produced by switch detector 21 is an interrupt signal. Paper feed detector 22 detects the amount of paper which is fed through printer 19 by adding and subtracting the drive pulses of motor 9 from the time the leading edge of the fan fold paper reaching the predetermined position of paper detector 7 to the time paper feeding stops. For example, when the leading edge of the fan fold paper passes the paper detector 7, paper feed detector 22 would begin to count the pulses of pulse motor 9. Recorder 23 records the contents of the paper feed detector 22 each time printing of fan fold paper is interrupted to allow the printing of cut sheet paper which is determined by the cut sheet signal produced by switch detector 21.

Figure 4:
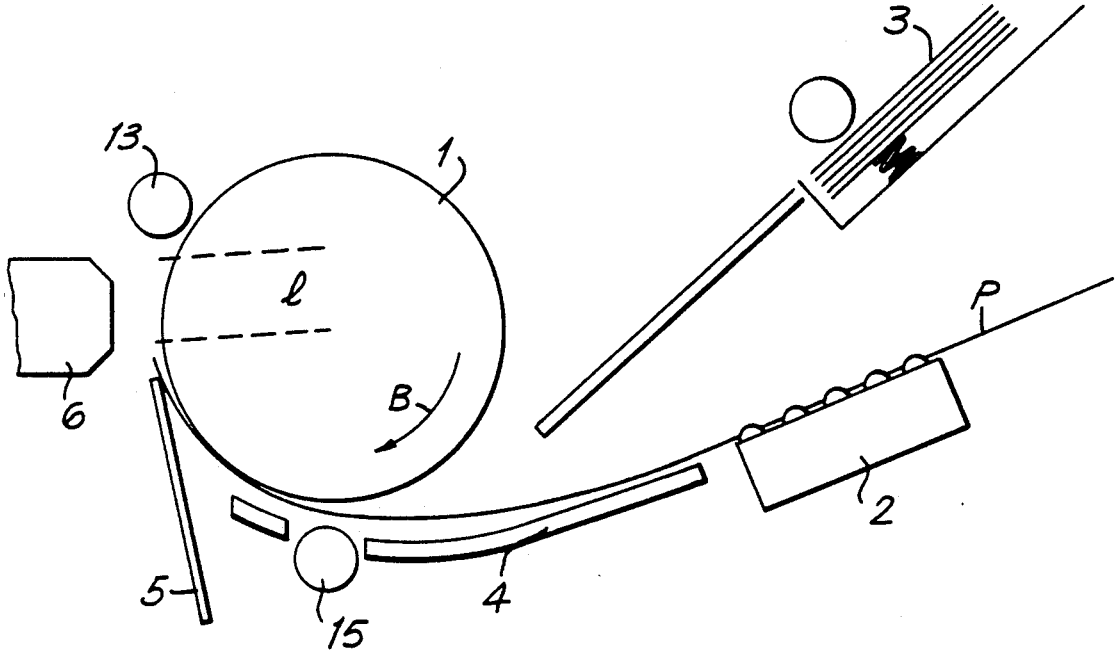
FIG. 4 is a schematic diagram of the apparatus of FIG. 1 during reciprocation.

When coincidence detector 24 detects a coincidence between the contents of recorder 23 and paper feed detector 22, it outputs a stop signal to driving circuit 10 to stop motor 9 upon the receipt of the cut sheet signal from switch detector 21. Reference position detector 25 detects the passing of fan fold paper past the reference position. Reference position detector 25 produces a signal causing the fan fold paper to be fed so that the leading edge of the fan fold paper projects a predetermined amount above paper press member 5. In this position the paper may be fed in a reciprocating manner so that the leading edge of the fan fold paper P moves between paper bail 13 and paper pressing member 5. (FIG. 5) In an exemplary embodiment this distance may be between 30 to 40 mm. Simultaneously, reciprocation setting circuit 26 outputs a signal for controlling the amount drive circuit 10 is to drive motor 9 in a reverse direction corresponding to a rotation amount l' in the reverse direction (FIG. 4) to perform a reciprocation in accordance with an output from the reciprocation instructing circuit 27.

Figure 3:
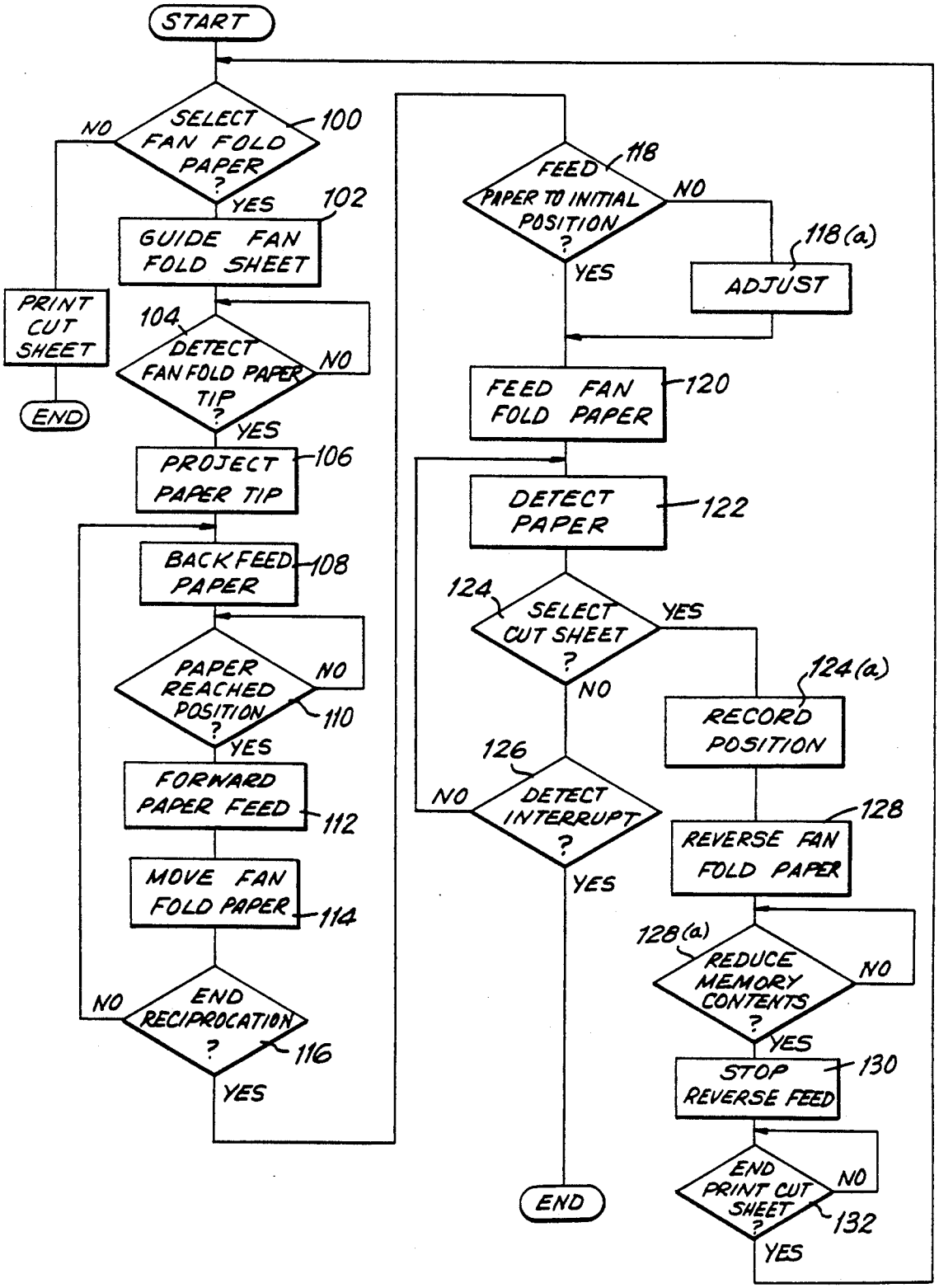
FIG. 3 is a flow chart illustrating the operation of the apparatus of FIG. 1.

Reference is now made to FIG. 3 wherein a flow chart illustrating operation of apparatus 25 is provided. Fan fold paper is selected to be printed by selecting a fan fold position of switch 11 in accordance with a step 100. Platen 1 is rotated forward with a slightly larger circumferential speed than push tractor feeder 2 feeds paper even though platen 1 and push tractor feeder 2 are both connected to motor 9 through a single transmission. Motor 9 drives push tractor 2 in a forward direction so that fan fold paper P is guided from a paper storage area towards platen 1 by paper guide 4 in accordance with a step 102. When the leading edge of fan fold paper P passes paper detector 7 in accordance with a step 104, reference position detector 25 outputs an indication signal. Thereby, reciprocation instruction circuit 27 feeds fan fold paper P to a predetermined position beyond paper pressing member 5 as shown in FIG. 5 in accordance with a step 106.

Figure 5:
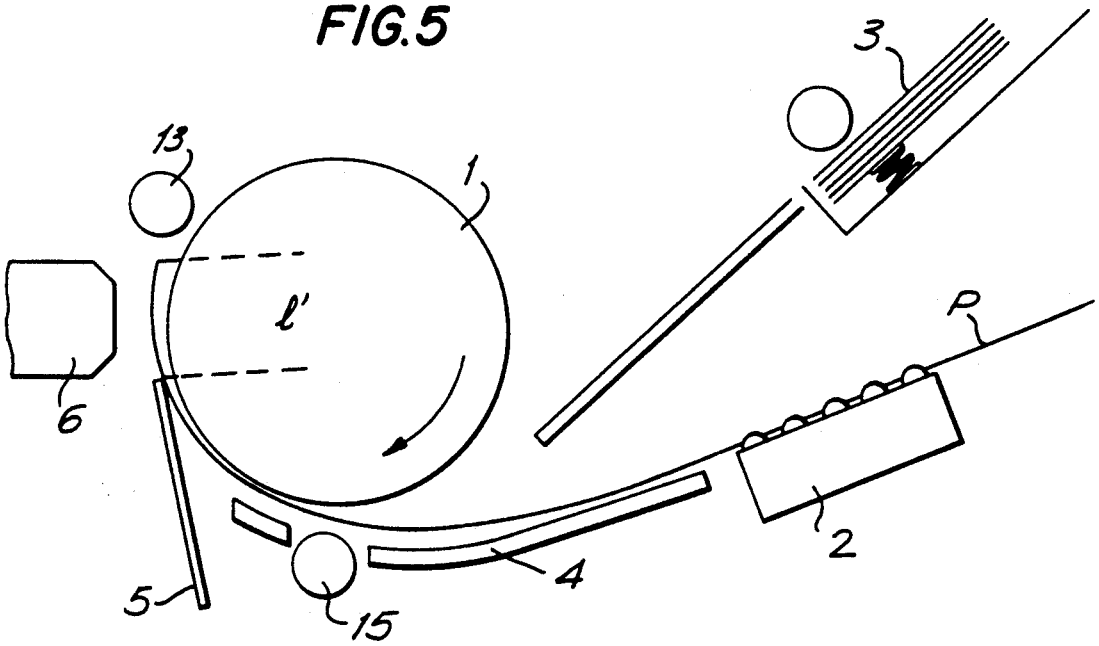
FIG. 5 is a schematic diagram of the apparatus of FIG. 1 during reciprocation.

As shown in FIG. 5, after step 106, the leading edge of fan fold paper P extends a distance l. Reciprocation instructing circuit 27 outputs a drive signal in accordance with a preset reciprocation setting stored in reciprocation setting circuit 26 causing motor 9 to drive push tractor feeder 2 in a reverse direction pushing paper P backwards by a distance l'. The paper is now in a proper predetermined position which is upstream of pressing member 5 in accordance with a step 110 and motor 9 is again rotated forward in a step 112. The fan fold paper is moved a predetermined position stored in reciprocation setting circuit 26 to bring the lead edge of fan fold paper P adjacent printhead 6 in accordance with a step 114.

This reciprocation is then repeated several times until a plurality of reciprocations has ended in accordance with a step 116. Fan fold paper P is fed to the initial position at which it was positioned prior to the interruption of the cut sheet paper or prior to the printer having been turned off and is maintained in that position in accordance with a step 118. If the initial position is not reached, the paper is adjusted in a step 118(*a*). Any sagging problems associated with the fan fold paper P is removed due to the tension in the paper feeding direction supplied by the sliding contact.

A print signal is then input once the initial setting of fan fold paper P is completed. Print head 6 is operated and prints across the paper width. When a line end has been reached and printing has ended, motor 9 drives push tractor feeder 2 to feed the paper by a print line in accordance with a step 120. This paper feeding amount is detected by paper feed detector 22 in accordance with a step 122.

During the fan fold paper print process, if cut sheet printing is required, switch 11 is set to the cut sheet mode in accordance with a step 124, the position is recorded in a step 124(*a*) and switch detector 21 detects an interrupt signal from switch 11 in accordance with a step 126. Paper feed detector 22 outputs its contents to recorder 23 and coincidence detector 24. Simultaneously, coincidence detector 24 sends a signal to driving circuit 10 causing motor 9 to stop.

Motor 9 is rotated in a reverse direction causing push tractor feeder 2 to move paper P in the reverse direction back towards a paper storage area in accordance with a step 128 so that fan fold paper P does not interfere with the feeding of cut sheet paper. The amount that paper P is back fed is determined by the amount of forward movement previously detected by paper feed detector 22 as in step 128(*a*). When fan fold paper P has been driven backwards to a predetermined position where it does not interfere with the printing of cut sheets, the reverse rotation of motor 9 is stopped in accordance with a step 130.

The printing of cut sheet paper may now begin. When the cut sheet printing ends in a step 132, the operator may return to printing on the fan fold paper by selecting the fan fold paper mode of switch 11. Switch detector 21 receives the input from switch 11 and produces an output which causes motor 9 to drive push tractor feeder 11 towards platen 1. When the leading edge of fan fold paper P passes paper detector 7, a signal is output to reciprocation instructing circuit 27. Paper feeding is continued until the leading edge of fan fold paper P projects beyond paper pressing member 5 by a predetermined amount which is determined by reciprocation instructing circuit 27.

Once paper feeding stops, motor 9 rotates in the reverse direction to return fan fold paper P towards push tractor feeder 2. Paper is fed backwards by an amount which has been previously set in reciprocation setting circuit 26 and motor 9 is then caused to rotate forward to feed paper in the direction of platen 1. When fan fold paper P has been fed forward for a predetermined amount, motor 9 is then again rotated in the reverse direction and the above process is repeated to provide a plurality of reciprocations in accordance with steps 100 through 116 discussed above.

When the reciprocations are completed, reciprocation instructions circuit 27 instructs driving circuit 10 to rotate motor 9 forward to move fan fold paper P in position relative to print head 6. During this movement, the amount of paper which is fed about platen 1 is detected by paper feed detector 22. When fan fold paper P has been reset to the position where printing had occurred prior to the interruption of cut sheet paper, the output value of the paper feed detector coincides with the data previously recorded in recorder 23. Coincidence detector 24 outputs a coincidence signal to motor driving circuit 10 to stop paper feeding. Accordingly, fan fold paper P is now positioned in its original position. The text to be printed on the fan fold paper is recalled to finish the interrupted printing thereby continuing printing at the point at which printing had been terminated in order to allow cut sheet printing.

In the above embodiment, platen 1 and push tractor feeder 2 are driven by a common motor 9. However, the same effect may be achieved in an apparatus in which the platen and push tractor feeder are driven by independent motors.

By providing a paper feeding device for a printer which may feed both fan fold paper and cut sheet paper including a platen, a paper pressing member for contacting with the platen at the leading edge of the paper for feeding the fan fold paper in first a forward direction and then upon interruption in a backward direction and then in a forward direction again to complete printing of the fan fold paper and in a reciprocating motion prior to returning the paper to the print position in the forward direction, paper sagging is eliminated and print displacement is prevented providing a higher quality of printing.

It will thus be seen that the objects set forth above, among those made apparent from the preceding description, are efficiently attained and since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which as a matter of language might be said to fall therebetween.

What is claimed is:

1. An apparatus for individually feeding both cut sheet paper and fan fold paper in a printer comprising a platen, a paper pressing member for elastically contacting the platen, the fan fold paper and cut sheet passing between the paper pressing member and the platen when printing is to occur thereon, a push tractor located upstream of the platen in the paper feed path, the push tractor feeding the fan fold paper when printing is to occur thereon, and control means for driving said push tractor in a reverse direction to remove said fan fold paper from the paper feeding path upon the feeding of cut sheet paper, means to tension from fan fold paper against said platen and thereby eliminate sag including means in said control means acting to feed the fan fold paper forward and backward in at least one reciprocation after the cut sheet paper has been fed to tension the fan fold paper and to feed the fan fold paper again in a forward direction for a length equal to the amount that the fan fold paper was fed in the reverse direction by the push tractor, whereby the fan fold paper is returned to its previous printing position.

2. An apparatus for individually feeding both cut sheet paper and fan fold paper in a printer comprising a platen, a paper pressing member for elastically contacting the platen, the fan fold paper and cut sheet passing between the paper pressing member and the platen when printing is to occur thereon, a push tractor located upstream of the platen in the paper fee path, the push tractor feeding the fan fold paper when printing is to occur thereon, and control means for driving said push tractor in a reverse direction to remove said fan fold paper from the paper feeding path upon the feeding of cut sheet paper, said control means acting to feed the fan fold paper forward and backward in at least one reciprocation after the cut sheet paper has been fed and to feed the fan fold paper in a forward direction for a length equal to the amount that the fan fold paper was fed in the reverse direction by the push tractor, whereby the fan fold paper is returned to its previous printing position; switch means for outputting an indication signal indicating that one of a cut sheet mode corresponding to feeding of cut sheet paper and a fan fold mode corresponding to feeding of fan fold paper has been selected, a paper detector for detecting the presence of the leading edge of the fan fold paper at a predetermined position and a driving circuit for driving the push tractor in response to an output from the control means, the control means including switch detector means for detecting the indication signal and providing an interrupt signal when the indication signal indicates a cut sheet mode, paper feed detector means for detecting the amount of fan fold paper fed by the push tractor prior to the producing of the interrupt detection signal and outputting the amount detected, recorder means for detecting the amount recorded by the paper feed detector means and producing a recorded output in response to the interrupt signal, coincidence detector means for producing a stop motor signal when the paper feed amount is essentially equal to the amount stored in the recorder means, the driving circuit causing the push tractor to stop feeding in response to the stop motor signal, a reference position detector for outputting a reference position detect signal when the paper detector means has detected the leading edge of the fan fold paper, reciprocation setting means for storing a predetermined reciprocation distance and producing a distance output signal ,and reciprocation instruction means for receiving the reference position detect signal and the distance output signal and outputting a reciprocation instruction signal to cause the push tractor to feed said fan fold paper in a forward and backward manner in response thereto.

3. A method for returning fan fold paper to an original print position in a printer adapted to feed both cut sheet paper and fan fold paper, the printer including a platen, a paper pressing member elastically contacting with the platen, a push tractor for feeding fan fold paper towards the platen and away from the platen and control means for driving the push tractor, comprising the steps of selecting a fan fold paper mode, feeding fan fold paper in a forward direction about the platen, detecting the amount of paper fed in the forward direction, detecting an interrupt signal and in response thereto feeding the fan fold paper in a reverse direction equal to the amount by which fan fold paper was fed in the forward direction, feeding cut sheet paper, feeding fan fold paper upon the completion of the feeding of the cut sheet paper until the leading edge of the fan fold paper projects beyond the paper pressing member, back feeding the fan fold paper a predetermined distance, forward feeding the fan fold paper a predetermined distance, and feeding the fan fold paper to a position corresponding to the amount of paper detected to be fed in the forward direction.

* * * * *